United States Patent [19]

Watts

[11] Patent Number: 4,691,543

[45] Date of Patent: Sep. 8, 1987

[54] DEADLOCK WITH KEY OPERATED LOCKING CYLINDER

[76] Inventor: John R. Watts, 87 Well St., Middle Brighton, Victoria 3186, Australia

[21] Appl. No.: 843,673

[22] Filed: Mar. 25, 1986

[51] Int. Cl.[4] ..... E05B 55/00

[52] U.S. Cl. ..... 70/143; 70/134; 70/475; 70/478; 292/150; 292/170

[58] Field of Search ..... 70/143, 475, 478; 292/170, 150

[56] References Cited

U.S. PATENT DOCUMENTS

| | | | |
|---|---|---|---|
| 1,286,344 | 12/1918 | Kenneweg | 70/143 |
| 1,553,531 | 9/1925 | Hoffman | 70/143 |
| 4,623,175 | 11/1986 | Carroll | 70/143 |

FOREIGN PATENT DOCUMENTS

| | | | |
|---|---|---|---|
| 419076 | 11/1934 | United Kingdom | 70/143 |

*Primary Examiner*—Robert L. Wolfe
*Attorney, Agent, or Firm*—Larson and Taylor

[57] ABSTRACT

A deadlock with a locking bolt having a tongue that is displaceable from a latched position to an unlatched position, the lock including locking means to displace the tongue past the latched position to a locked position. The locking tongue is similarly curved on both sides so that, in use, it slides past a striker plate to the latched position in both right and left hand locking doors. A multi-point deadlock in which a center lock is coupled to at least one auxiliary lock via transmission mesans. The center lock having handles coupled to the latching tongue of the center lock and the transmission means so that downward movement of either handle causes the center lock to unlatch and upward movement of either handle from the horizontal drives the transmission means to effect locking of the auxiliary lock.

20 Claims, 22 Drawing Figures

Figures 1, 5, 6:
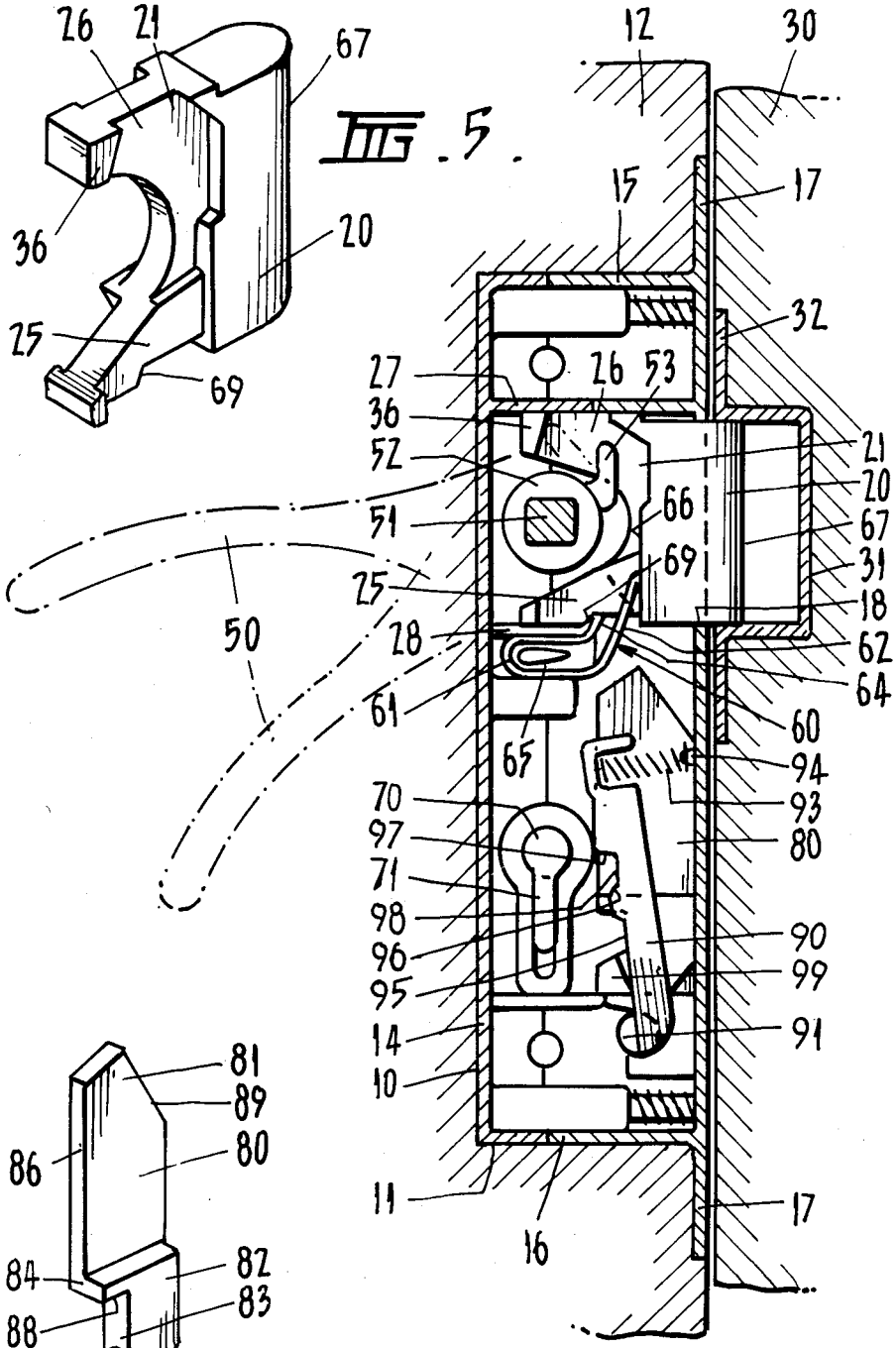

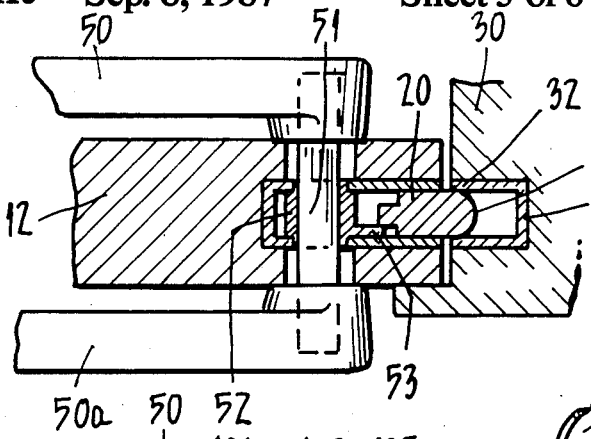
FIG. 7.
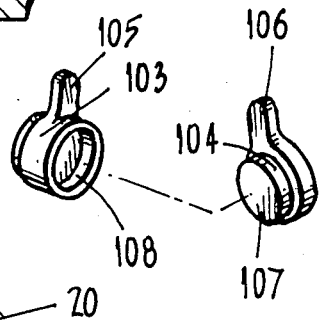
FIG. 9.
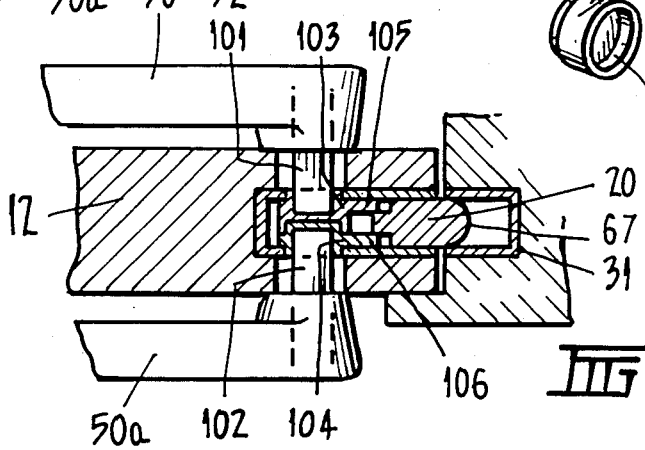
FIG. 8.
FIG. 10.
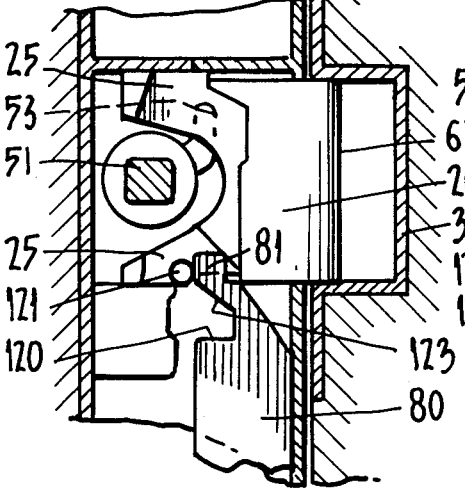
FIG. 11.
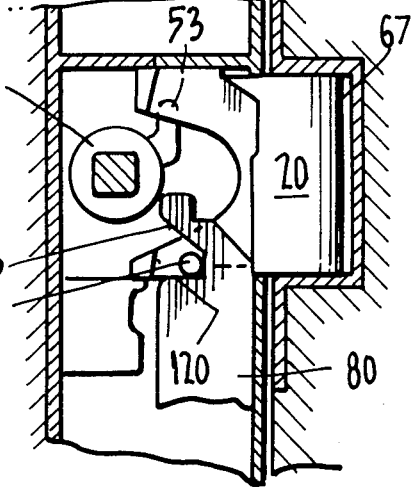

DEADLOCK WITH KEY OPERATED LOCKING CYLINDER

This invention relates to locks especially deadlocks. In particular the invention relates to deadlocks for use in screen doors. The invention also relates to multi-point locks for screen doors.

A problem frequently encountered with locks concerns the design of the locking tongue that in use slides past a striker plate in the door jamb to effect latching of the lock. It is common practice for the locking tongue to have an inclined surface that allows the tongue to slide past the striker plate. However, this surface only allows the tongue to slide past the striker plate in one direction and thus if the lock operates satisfactorily on a right-hand locking door and it is wished to use the lock on a left-hand locking door the locking tongue has to be reversed so that the curved surface can slide past the striker plate. The necessity for reversing the locking tongue is an inconvenient exercise for those fitting locks. The present invention is concerned with this problem.

In some cases it is desirable to have more than one locking point resulting in the use of three-point locks having a centre lock and locks at the top and bottom of the door. It has also been suggested to provide a single locking cylinder that operates all three locks. However, the mechanical moment that is necessary to displace the locking tongues of three locks can be so great that the torque that has to be applied by the key is too great for the young or infirmed to turn the key or can result in key breakage. The present invention is also concerned with this problem.

The present invention provides a deadlock comprising a lock casing, a locking bolt displaceable within said lock casing, the bolt having a locking tongue arranged, in use, to engage a striker plate, means to displace said locking bolt from a latching position where the tongue extends a short distance out of said lock casing to an unlatched position wherein the tongue is wholly within the casing, and locking means comprising a lock slide to drive the tongue past the latching position to a locked position with the locking tongue extending a substantial distance out of the lock casing, the locking tongue being similarly curved on both sides so that, in use, either side can slide past a striker plate to the latched position thereby enabling the lock to be used in both left and right hand locking doors.

Preferably the locking tongue comprises a substantially rectangular projection having a leading face that is uniformly radiused to allow either side of the tongue to slide past the striker plate.

Preferably, the lock has a handle on each side of the casing interconnected by a shaft which drives a cam that engages the locking bolt to displace the bolt from the latched position to the unlatched position.

In another, embodiment there is provided a multi-point lock comprising one or more subsidiary locks spaced remote from the deadlock described above, each subsidiary lock including a locking bolt displaceable from a locked position to an unlocked position, transmission means connecting said subsidiary locks to the deadlock and displaceable to drive said subsidiary locking bolts to and from the locked position, means to drive said transmission means, said means being actuatable by displacement of either handle of the deadlock in a direction opposite to the direction which unlatches the deadlock.

Each subsidiary lock preferably comprises a casing having a front face with an aperture therein, the casing supporting a locking bolt displaceable from an unlocked position in which the whole of the bolt is within the casing to a locked position in which part of the bolt extends out of the casing through the aperture, a slide mounted on the rear of the casing displaceable longitudinally of the casing, and a toggle assembly secured to the casing between the locking bolt and the slide so that displacement of the slide causes the toggle assembly to pivot to drive the locking bolt to the locked position.

The present invention also provides a multi-point lock comprising a centre lock coupled to at least one subsidiary lock via transmission means, the centre lock comprising a casing having a bolt displaceable therein, the bolt having a tongue arranged, in use, to engage a striker plate on a door jamb, a pair of handles positioned one on each side of the primary lock casing, and a triple cam assembly positioned within the primary lock casing interconnecting the pair of handles to the transmission and the bolt, the triple cam operating whereby rotation of either handle in a downward direction causes the tongue of the primary lock to assume an unlatched position and upward rotation of either handle causes the triple cam to impart drive to the transmission means to cause the subsidiary locks to assume the locked position.

Figure 12:
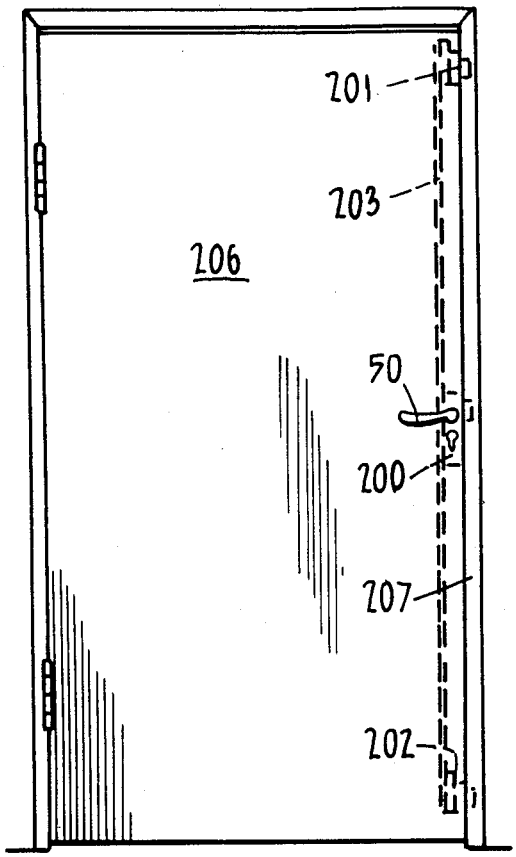
Figure 13:
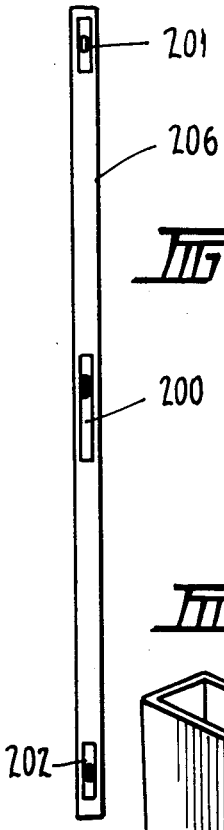
Figure 21:
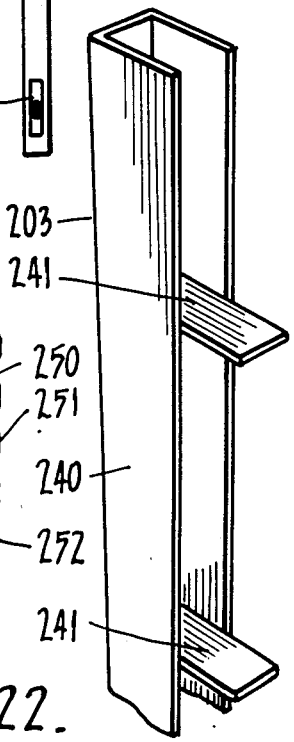
Figure 22:
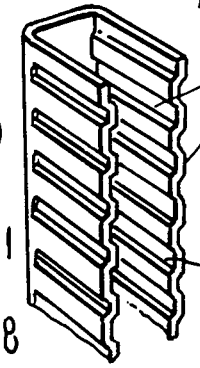
Figure 17:
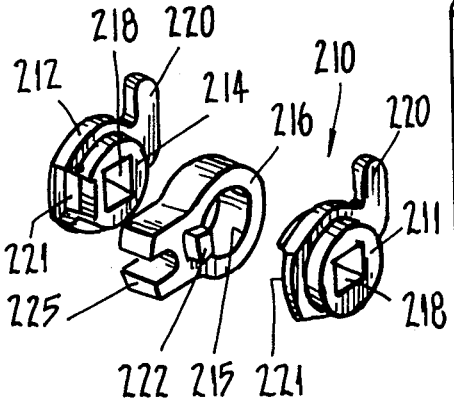
Figure 15:
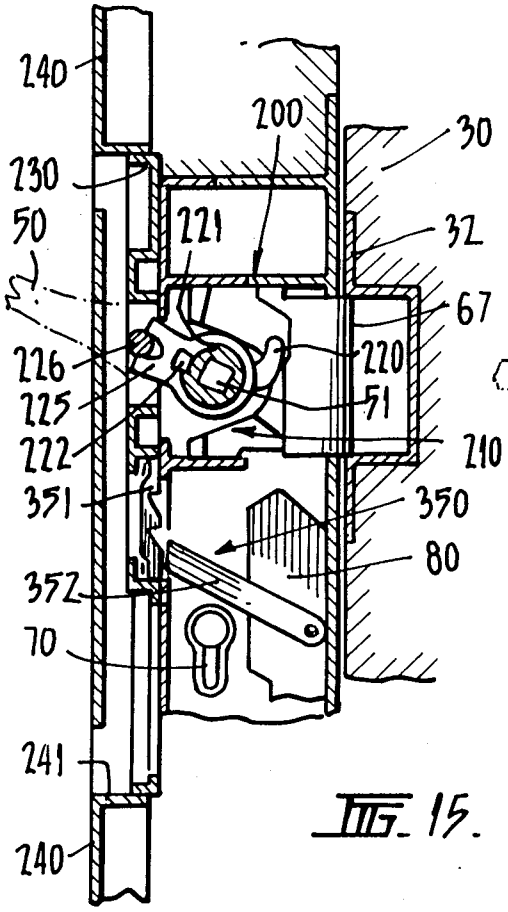
Figure 14:
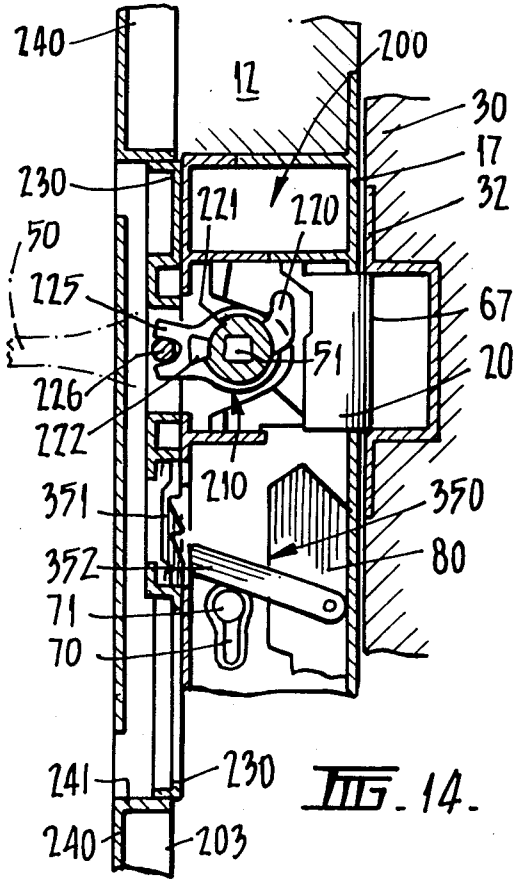
Figures 18, 19, 20:
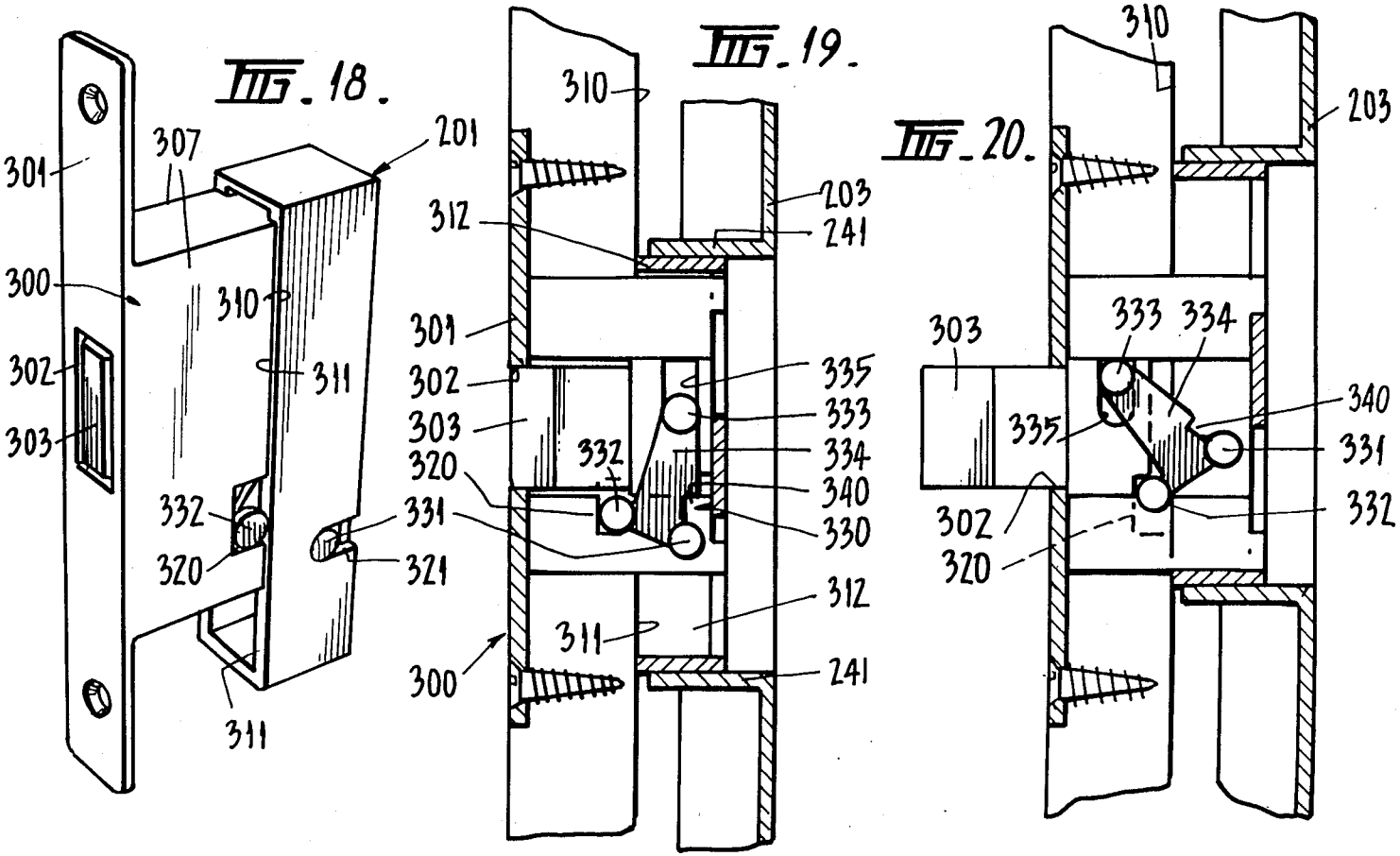

Various embodiments of the present invention will now be described by way of example only with reference to the accompanying drawings in which:

FIGS. 1 to 4 are cross-sectional views of a reversible dead lock in various stages of operation, FIG. 5 is a perspective view of a locking bolt for use in the lock illustrated in FIGS. 1 to 4, FIG. 6 is a perspective view of a lock slide for use in the lock illustrated in FIGS. 1 to 4, FIG. 7 is a cross-sectional plan view of the lock illustrating a single cam, FIG. 8 is a cross-sectional view of the lock illustrating use of a double cam, FIG. 9 is a perspective view of the double cam, FIGS. 10 and 11 are cross-sectional views of another embodiment of the lock showing the operation of a different means of driving the locking bolt, FIGS. 12 and 13 are respectively side and end elevational views of a door incorporating a three-point lock, FIGS. 14, 15 and 18 are cross-sectional views of the centre portion of a three-point lock illustrating the operation of the lock, FIG. 17 is a perspective view of a triple cam for use in the lock illustrated in FIGS. 14 to 16, FIG. 18 is a perspective view of a subsidiary lock for use in the three-point lock, FIGS. 19 and 20 are sectional views of the subsidiary lock illustrating the lock in the locked and unlocked positions, FIG. 21 is a perspective view of a transmission means for use in three-point lock; and FIG. 22 is a perspective view of part of an alternative form of transmission means for use in a three-point lock.

A deadlock as illustrated in FIGS. 1 to 11 comprises a rectangular metal casing 10 that is located within a recess 11 formed in a door 12. The door is preferably of comparatively light construction such as a screen or security door. The lock casing 10 has a rear face 14, side faces 15 and 16 and a front plate 17. The front plate 17 may be either formed integrally with the lock casing or may be attached thereto by suitable fasteners. The front plate 17 is provided with a rectangular aperture 18 through which the tongue 20 of a locking bolt 21 is arranged to slide.

In a conventional manner the door is arranged to close against the door jamb 30 having therein a recess 31 over which is positioned a steel striker plate 32.

The locking bolt 21 comprises spaced arm portions 25, 26 having linear parallel edges that are arranged to slide within parallel guides 27, 28 formed in the lock casing 10. The arms 25, 26 merge into the locking tongue 20. The lock is provided with a pair of handles 50, 50*a* positioned on each side of the door. The handles drive a spindle 51 that extends transversely of the lock casing to drive a latching cam 52 that has a projecting finger 53 that is arranged to engage a projection 36 on the arm 26 to cause displacement of the locking bolt relative to the lock casing. A strip steel spring 60 locates within a recess 65 provided in the lock casing and comprises a U-shaped body portion 61 terminating in a longer leg 62 and shorter leg 63 having an upturned tab 64. The longer leg 62 of the spring engages the rear face 66 of the locking tongue and has the effect of urging the locking tongue out of the casing to the position shown in FIG. 1. This is the latched position with the nose 67 of the locking tongue projecting a short distance out of the lock casing to engage the recess covered by the striker plate 32 in the door jamb. The tab 64 extends upwardly to engage an abutment 69 formed on the arm 25 of the locking bolt to act as a detent preventing the longer leg 62 of the spring forcing the locking tongue past the latched position.

It is understood that other types of spring may be used to urge the tongue to the latched position and separate means such as a spring loaded ball may be used to act as the detent A small spring (not shown) is positioned between the handle and spindle 51 to ensure that the handle 50 assumes a neutral horizontal position. In this position, the spring 60 causes the locking tongue to be urged to the latched position shown in FIG. 1. As the handle 50 is pulled down to the position shown in dotted line in FIG. 1 or the position in FIG. 2, the finger 53 on the cam 52 engages the abutment 36 on the arm 26 of the locking bolt to cause the locking bolt to be pulled into the casing to assume the unlatched position shown in FIG. 2. This has the effect of pulling back the longer arm 62 of the spring to compress the spring 60. When the handle is released the spring (not shown) forces the handle to assume the neutral position and the spring force of the spring 60 has the effect of causing the locking tongue 20 to be displaced outwardly to reassume the position shown in FIG. 1.

As can be seen with particular reference to FIGS. 5, 7 and 8, the nose 67 of the locking tongue presents a smoothly curved radiused edge to each side of the tongue. The radius of the curved nose is such that the tongue can ride up the striker plate in the door jamb from either side and yet still assume a latched position when the door is closed. The radius of curvature of the tongue and the small distance that the tongue projects out of the casing in the latched position have been carefully chosen to provide this feature so that the lock can be used both in left and right hand doors without having to reverse the locking tongue. This feature makes the operation of selecting and fitting a lock much simpler.

The locking facility of the lock described above is effected by use of a conventional locking cylinder 70 that is located transversely of the casing to be operable from either side by a suitable key. A lock slide 80 is located within the casing to be in sliding engagement with the casing front face 17. A rocker 90 is also located in the casing adjacent the lock slide 80 to be pivotable away from the front face 17 of the lock casing by a small coil spring 93. The lock slide is illustrated in further detail in FIG. 6.

Figures 2, 3, 4:
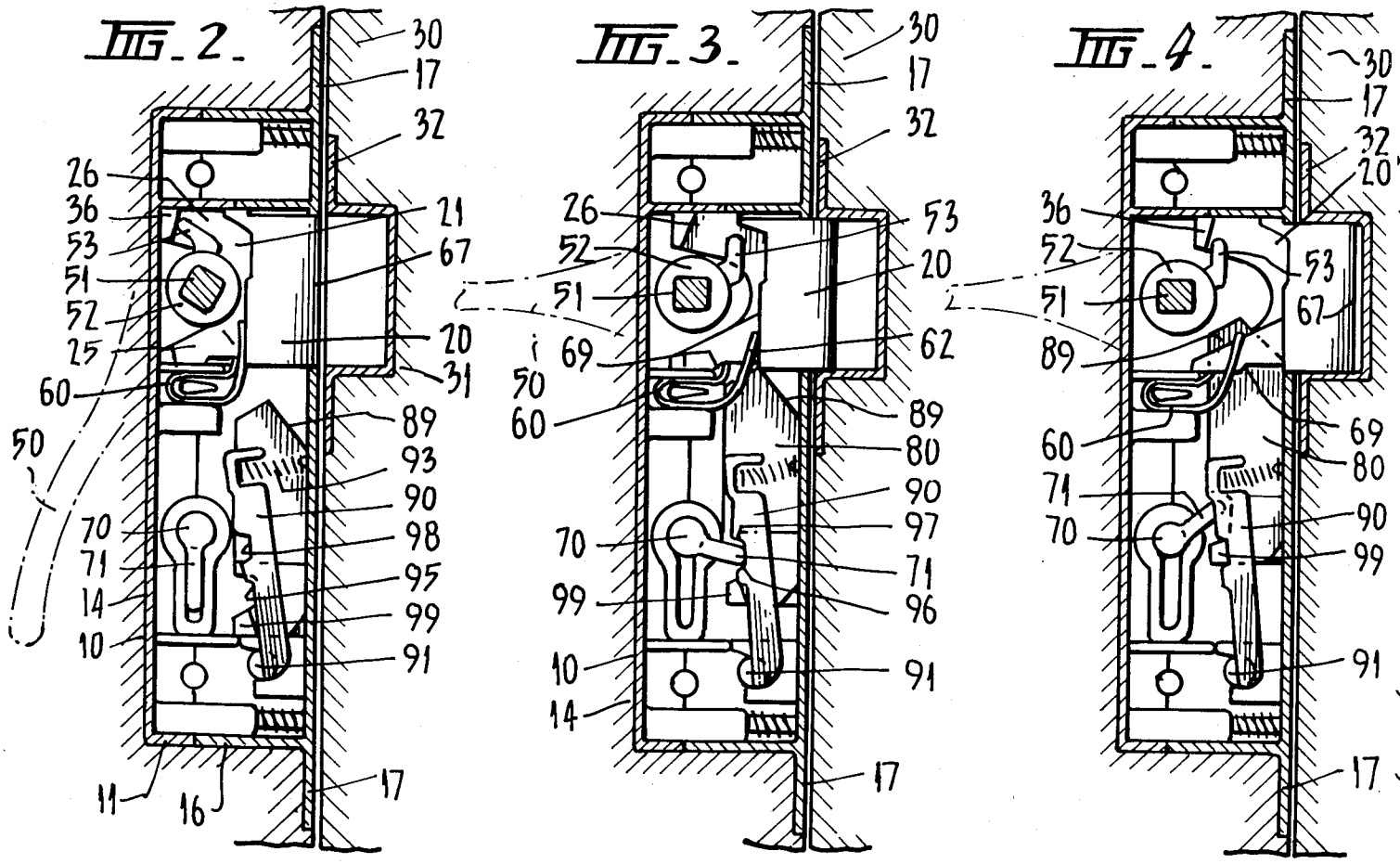

As shown in FIG. 6 the lock slide 80 is substantially rectangular having a pointed end 81 with an inclined edge 89. The pointed end merges into a thin planar portion 86. The planar portion 86 terminates in a stepped portion 82 that has a recess 83 cut out of one side 84. At the end of the stepped portion 82 adjacent the recess 83 is provided an outward projection 99. The locking cylinder 70 is provided with a rotatable arm 71 that, as shown in FIG. 3 can be turned by the key to engage one face 88 of the recess 83 in the lock slide 80. Further turning of the arm 71 has the effect of causing the slide 80 to be displaced upwardly as shown in FIGS. 3 and 4. Upward displacement of the lock slide 80 causes the pointed end 81 to engage the inner surface 66 of the locking tongue. The inclined surface 89 of the pointed end 81 of the lock slide as it moves upwardly forces the locking tongue 20 outwardly of the casing. The force pushing the locking tongue out of the casing is sufficiently great to cause the shoulder 69 on the arm 25 to ride over the detent formed by the tab 64 at the end 63 of the spring 60. A full turn of the key causes the locking arm 71 to assume the position shown in FIG. 4 that is with the locking tongue projected a substantial distance out of the lock casing and into the recess 31 formed in the door jamb 30. In this position, the slide 80 has been pushed upwardly to the extent that the base of the locking tongue has reached the end of the inclined portion 89 on the pointed end 81 of the lock slide 80.

The rocker 90 operates to provide the deadlock effect, namely to prevent someone inserting a card or screw driver against the tongue and forcing the locking tongue back to the unlocked position. The rocker 90 is an elongate member having a lug 91 at one end that is located in a suitable recess in the lock casing to allow the rocker to pivot about the casing. A small recess 92 is provided adjacent the other end of the rocker and this recess houses a small spring 93 that is located by a peg 94 projecting from the inside of the front face 17 of the lock casing. The spring has the effect of forcing the upper end of the rocker away from the front face of the casing. One edge 95 of the rocker is provided with a pair of shoulders 96 and 97 that define a cut-out 98. As the arm on the locking cylinder is rotated by the key, it reaches a position where it contacts the shoulder 96 and pushes the rocker 90 towards the front face of the lock against the spring 93. When the rocker is pushed forward the projection 99 formed on the base on the lock slide 80 is free to move past the shoulders 96 and 97 on the rocker. However, once the lock slide has displaced the locking tongue to the locked position as shown in FIG. 4, the arm 71 on the locking cylinder escapes past the shoulder 96 on the rocker and allows the rocker to spring back to the position shown in FIG. 4. This causes the cut-out 98 formed by the shoulders 96 and 97 to engage around the projection 99 formed on the base of the lock slide 80. The location of this projection 99 in the cut-out has the effect of preventing downward movement of the slide 80. Thus, should an attempt be made to unlock the lock by pressing the locking tongue back into the casing, the interconnection of the rocker 90 and lock slide 80 would prevent displacement. The only way that the slide can be reversed is for a key to be inserted into the locking cylinder and the arm 71 turned back to move the rocker 90 away from the lock slide 80 to effect release of the projection 99 from the cut-out 98. This combination provides the deadlock feature of the lock.

In the embodiment described above, the key operated locking cylinder merely returns the slide 80 from the locked position to the unlocked position. The locking tongue 20 remains in the locked position as shown in FIG. 4. To effect return of the tongue, the handle 50 has to be depressed to rotate the finger 53 on the cam 52 to drive the locking bolt back to the unlocked position. In the embodiment illustrated in FIGS. 10 and 11, the pointed end 81 of the slide 80 is provided with a cut out 120 on its rear face that is arranged to slide over a projecting lug 121 formed on the arm 25 of the locking bolt. Once the locking bolt has assumed the locked position as shown in FIG. 11, the lug 121 locates within the cut-out 120 in the lock slide 80 so that when the locking cylinder is unlocked and the locking slide 80 pulled down to the unlocked position, the downward movement causes the lug to ride up an inclined face 123 in the cut-out in the slide thereby pulling the locking bolt back from the locked positioned to the unlocked latched position. The bolt is held in this position by the projecting tip 81 of the slide engaging the lug 121 preventing the spring from urging the bolt past the latched position of FIG. 10. Thus, in this embodiment, there is no need to use the handle to unlock the lock. In an alternative form it is understood that the lug 121 and cut-out 120 may be reversed and provided on the slide 80 and bolt 20 respectively.

In the embodiment illustrated in FIGS. 1 to 7, a single cam 52 is used to drive the locking bolt from the latched to the unlatched position. This drive means is illustrated in more detail with reference to FIG. 7 where both handles 50, 50*a* are shown driving a single spindle 51 that extends transversely through the lock casing. However, in FIG. 8 a variation is illustrated in which a pair of spindles 101 and 102 are utilized each driving a separate cam component 103, 104 having projecting fingers 105, 106. As shown in FIG. 9, the components 103, 104 of the double cam fit together with a projection 107 on one, fitting within a circular recess 108 on the another so that they are rotatable relative to each other. Although not shown in FIG. 9 each cam is also provided with a squared recess that accommodates the end of the respective spindles to impart drive from the spindle to the cam. The effect of this feature is that one handle can be displaced without necessarily moving the other handle. The drive to the locking bolt is effected in the same manner as described earlier except the projection on which the finger of the cam engages is provided on both sides of the locking bolt. The differences are clearly illustrated in FIGS. 7 and 8.

The embodiment illustrated in FIGS. 12 to 22 relates to a three-point lock for use on screen doors. The lock comprises a central locking unit 200 with a latching facility operable by handles on both sides of the door and a key operated locking cylinder. The central locking unit 200 is interconnected to a pair of auxiliary locking units 201 and 202 by transmission means 203. The auxiliary locking units are positioned towards the top and bottom of the door respectively and do not possess a latching feature. The auxiliary locks, details of which will be described later in the specification, assume a locked configuration on displacement of the transmission means. The transmission means is displaced to effect locking of the subsidiary locks by an upward displacement of either handle.

As shown in FIGS. 12 and 13, the transmission means 203 is housed within the door 206 to extend in a vertical fashion adjacent to and parallel the edge of the door that faces the door jamb 207.

Figure 16:
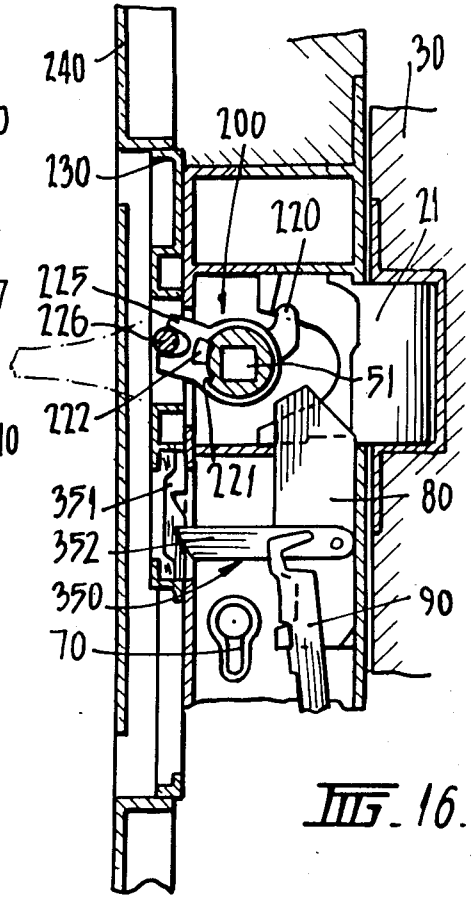

The means to effect drive to the transmission enabling locking of the auxiliary locks is illustrated with particular reference to FIGS. 14 to 16. The majority of the lock components are similar to those described earlier in the specification and the same reference numerals are used to designate like components.

However, with the centre lock of the three-point lock illustrated in FIGS. 14 to 16, a triple cam assembly 210 illustrated in detail in FIG. 17 is driven by the door handles to displace both the locking bolt 21 of the centre lock 200 and the transmission means 203. The triple cam 210 comprises a pair of outer cams 211 and 212, each comprising a substantially circular protruding boss 213, 214 that is arranged to be located within a cylindrical throughway 215 formed on a centre cam 216. The location of the bosses within the cylindrical throughway allows the outer cams 211 and 212 to be rotatable relative to the centre cam 216. The boss of each outer cam is provided with a squared aperture 218 into which a respective spindle 51 driven by the door handle 50 is located. Thus, rotation of a respective door handle in either direction causes a corresponding rotation of the respective cam. Each outer cam 211 or 212 is also provided with an outwardly projecting finger 220 that drives the locking bolt in the same manner as the embodiment described with reference to FIGS. 1 to 11. Thus, as the respective handle 50, 50*a* is pulled down, the spindle 51 causes rotation of the respective outer cam 211 or 212 and the finger 220 to pull the locking bolt 21 from the latched to the unlatched position. As shown in FIG. 17, each outer cam 211 or 212 is provided with an arcuate slot 221 at the rear of the cam, namely on the diametrically opposite side to the finger 220. The centre cam 216 is provided with a pair of projecting lugs one 222 of which locates in a respective arcuate slot 221 of the outer cam. The location of the lugs in the slots in the outer cam 211, 212 is such that when the lock is unlocked and the cams are rotated in a counter clockwise direction by a downward depression of the handles of the door, the arcuate slots 221 move relative to the lugs 222 without imparting motion to the centre cam 216. However, when either handle 50, 50*a* is pulled upwardly, causing a clockwise rotation of the outer cam the lug 222 engages the extremity of the slot 221 of the respective outer cam to impart motion to the centre cam 216. The centre cam 216 is provided with a forked drive arm 225 that, as shown in FIG. 14 engages a spindle 226 formed on a drive plate 230. The drive plate 230 is secured to the rear face of the casing to the slidable thereto and is driven by the forked drive arm 225 location on the spindle 226. The arrangement of the lugs 222 within the arcuate slots 221 in the outer cams 211, 212 is such that an upward motion of either handle causes displacement of the drive plate 230 in the one direction.

After the handle has been pulled upwardly to lock the subsidiary locks the interengagement of the cams 211, 212 and 216 is such that the outer cams turn back to allow the handle to assume the neutral (horizontal) position. When in this orientation, that is with the transmission means in the up position (FIG. 15) downward displacement of either handle causes drive to be imparted to the centre cam 216 to effect return of the transmission means and to unlock the subsidiary locks. The handle is then free to return to the neutral (horizontal) position and the assembly assumes the configuration of FIG. 14.

There are two forms of transmission means 203 illustrated in FIGS. 21 and 22. In the form illustrated in FIG. 21, a simple elongate channel 240 is provided having projecting plates 241 spaced to accommodate the drive plate 230 of the centre lock 200 as shown in FIGS. 14 and 15 and the body of the auxiliary locks at the extreme ends of the channel. In an alternative form, the channel 250 is provided with inwardly extending projections which form a series of parallel ridges 251 and troughs 252 which interengage with similar formations found on the drive plate 230. This transmission means 203 has the advantage that it is more versatile than the embodiment illustrated in FIG. 21 where the positioning of the plates 241 determines the positioning of the centre lock. It is understood that the projections could be in the form of an array of spaced dimples which would interengage with depressions formed on the drive plate 230.

Each auxiliary lock 201, 202 is illustrated in detail with reference to FIGS. 18 to 20. Each auxiliary lock comprises a rectangular lock casing 300 having a face plate 301 with a central rectangular aperture 302 through which a locking bolt 303 is arranged to slide. The rectangular casing 300 has side plates 307.

The rear 310 of the lock casing extends within a rectangular aperture 311 formed in the front of a slide 312 that is in the form of an open rectangular section. The slide 312, as shown in FIGS. 19 and 20 is located within the space 316 defined by the plates 241 formed in the transmission means. As shown in FIGS. 19 and 20, a toggle mechanism 330 comprises a triangular plate 334 having pins 331, 332, and 333 located to project outwardly from each corner. The pins 331 and 332 are located respectively within slots 321 and 320 in the side wall of the casing 300 and slide 312. The third pin 333 locates within a U-shaped slot 335 positioned in the rear locking bolt 303. As can be seen with particular reference to FIGS. 19 and 20, as the slide 312 is displaced relative to the casing 300 the toggle plate 334 pivots about the pin 332 to move from the position shown in FIG. 19 to the position shown in FIG. 20 in effect causing the pin 333 to force the locking bolt 303 outwardly into the locked position. The upward movement of the slide 312 also has the effect of causing the pin 332 to ride up the slot 320 in the casing 300 and, after the bolt 303 has moved to the locked position located behind a notch formed on the rear face of the bolt 303 thus preventing return of the bolt 303 to the unlocked position and effecting deadlock of the auxiliary lock.

Deadlocking of the subsidiary locks 201, 202 is further effected by locking the transmission means 203 by a mechanism mounted in the centre lock 200 comprising a ratchet and pawl mechanism 350 illustrated in FIGS. 15 and 16. The drive plate 230 at the rear of the lock casing of the centre lock 200 is provided with a serrated ratchet 351 and a pawl 352 is pivotally secured to the lock slide 80. When the lock slide 80 is in the unlocked and downward position shown in FIG. 15, the drive plate 230 and ratchet 351 are free to slide past the pawl 352. However, when the keyed locking cylinder 70 is operated to displace the lock slide 80 upwardly as shown in FIG. 16 the pawl 352 drops to a horizontal position and locates against the ratchet 351 preventing downward movement of the locking plate 230. With the lock slide 80 held in this position by the rocker arm 90, downward movement of the drive plate 230 past the pawl 352 is prevented and thus, the auxiliary locks 201, 202 are deadlocked.

To effect release of the deadlock, the keyed cylinder 70 must be turned to release the rocker 90 and allow withdrawal of the lock slide 80 thereby releasing the pawl 352 from the ratchet 351 and allowing the locks to be unlocked by a downward movement of the handle 50. To lock the assembly the key operated locking cylinder 70 is turned to the locked position and the handle 50 is then moved upwardly to cause locking plate 230 and ratchet to ride over the pawl 352 to assume the locked position shown in FIG. 16 in which the auxiliary locks 201, 202 assumed the locked position of FIG. 20.

The main advantage of the three-point lock described above is that the auxiliary locks are driven into the locked position by the handles of the door. The handles are sufficiently robust to provide considerable moment to the transmission means and thus, auxiliary locks of a substantial nature can be utilized and adequate forces can be applied to ensure that they assume the locked position. The key operated lock cylinder merely operates the locking bolt of the centre lock and does not move the locking tongues of the auxiliary locks.

Having now described my invention, what I claim is:

1. A deadlock comprising a lock casing, a locking bolt displaceable within said lock casing, the bolt having a locking tongue arranged, in use, to engage a striker plate, means to displace said locking bolt from a latched position where the tongue extends a short distance out of said lock casing to an unlatched position wherein the tongue is wholly within the casing, locking means comprising a lock slide to drive the tongue past the latched position to a locked position with the locking tongue extending a substantial distance out of the lock casing, and a key operated locking cylinder having an arm which engages the lock slide to displace the slide so that the slide presents an inclined surface to the locking bolt at the rear of the locking tongue to force the tongue outwardly of the casing to the locked position with a portion of the side extending behind the locking tongue, the locking tongue being similarly curved on both sides so that, in use, either side can slide past a striker plate in the latched position thereby enabling the lock to be used in both left and right hand locking doors.

2. The deadlock of claim 1, wherein the locking tongue comprises a substantially rectangular projection having a leading face that is uniformly radiused to allow either side of the tongue to slide past the striker plate.

3. The deadlock according to claim 1, wherein in the locked position a rocker arm is biased into a position in which it prevents return of the slide, reverse movement of the arm by the key operated locking cylinder causing displacement of the rocker arm away from the slide to allow return of the slide by further reverse movement of the arm.

4. The deadlock according to claim 3 wherein the interengagement of the slide with the locking tongue is such that the return of the slide causes the tongue to be withdrawn from the locked position to the latched position.

5. The deadlock according to any one of the preceding claims, wherein the lock has a handle on each side of the casing interconnected by a shaft which drives a cam that engages the locking bolt to displace the bolt from the latched position to the unlatched position.

6. The deadlock according to claim 1, wherein the lock has a handle on each side of the casing, each handle driving a separate cam whereby each cam engages the locking bolt to displace the bolt from the latched position to the unlatched position.

7. The deadlock according to claim 1, comprising biasing means between the casing and the bolt to urge the bolt to the latched position.

8. The deadlock according to claim 7, further comprising a detent preventing the biasing means from pushing the locking bolt past the latched position, displacement of the lock slide causing the detent to becomes inoperative.

9. The deadlock according to claim 8, wherein the detent and biasing means are formed on a spring comprising a body having a primary arm that engages the rear of the locking tongue and a secondary arm that acts as the detent by projecting into the path of the locking bolt to resist further movement.

10. A multi-point lock comprising one or more subsidiary locks spaced remote from the deadlock as claimed in claim 6, each subsidiary lock including a locking bolt displaceable from a locked position to an unlocked position, transmission means connecting said subsidiary locks to the deadlock and displaceable to drive said subsidiary locking bolts to and from the locked position, means to drive said transmission means, said means being actuable by displacement of either handle of the deadlock in a direction opposite to the direction which unlatches the deadlock.

11. The multi-point lock according to claim 10 wherein the deadlock casing includes a ratchet assembly displaceable from an inoperative position to an operative position by the locking cylinder to prevent return of the transmission means and movement of the locking tongue of the subsidiary locks to the unlocked position.

12. The multi-point lock according to claim 11, wherein the ratchet assembly comprises a ratchet mounted on the transmission means and a pawl pivotally secured to the locking slide to engage the ratchet when in locked position and allow the ratchet to slide past the pawl when the slide is in the unlocked position.

13. The multi-point lock according to claim 10, wherein the deadlock includes a triple cam comprising a pair of outer cams, each driven by one handle and a centre cam in engagement with said outer cams and coupled to said transmission means whereby downward movement of either handle causes a respective outer cam to drive the locking bolt to the unlatched position and upward movement of either handle causes the respective outer cam to rotate the centre cam to cause displacement of the transmission means to effect actuation of the subsidiary locks.

14. The multi-point lock according to claim 13, wherein the interconnection of the outer cams and the centre cam is such that each outer cam can return to the neutral position without rotating the centre cam to, in use, allow each handle to return to a neutral (horizontal) position after the locking of the subsidiary locks has been effected, and further downward movement of either handle causes rotation to be imparted to the centre cam to return the transmission means to the unlocked position.

15. The multi-point lock according to claim 10, wherein each subsidiary lock comprises a casing having a front face with an aperture therein, the casing supporting a locking bolt displaceable from an unlocked position in which the whole of the bolt is within the casing to a locked position in which part of the bolt extends out of the casing through the aperture, a slide mounted on the rear of the casing displaceable longitudinally of the casing, and a toggle assembly pivotally secured to the casing between the locking bolt and the slide so that displacement of the slide causes the toggle assembly to pivot to drive the locking bolt to the locked position.

16. The multi-point lock according to claim 15, wherein the toggle assembly comprises a triangular toggle having one corner secured to the slide, one corner secured to the locking bolt and the third corner secured to the casing whereby displacement of the slide relative to the casing causes the toggle to pivot about the casing and displace the bolt to the locked position.

17. The multi-point lock according to claim 15, wherein the location of the toggle relative to the casing is such that after the bolt has been displaced to the locked position the toggle moves upwardly relative to the casing to locate behind the bolt to prevent return of the bolt to the unlocked position.

18. The multi-point lock according to claim 10, wherein the transmission means comprises a length of open channel into which is located the slide of the auxiliary lock and a drive plate formed on the back of the deadlock whereby movement of the plate imparts movement to the channel to, in turn, displace the slide on the rear of the auxiliary lock.

19. The multi-point lock according to claim 18, wherein the interior of the channel has an array of equally spaced ribs and troughs that engage similarly positioned ribs and troughs formed on the slide of the auxiliary lock and drive plate of the deadlock.

20. A multi-point lock comprising a centre lock coupled to at least one subsidiary lock via transmission means, the centre lock comprising a casing having a bolt displaceable therein, the bolt having a tongue arranged, in use, to engage a striker plate on a door jamb, a pair of handles positioned one on each side of the primary lock casing, and a triple cam assembly positioned within the primary lock casing interconnecting the pair of handles to the transmission and the bolt, the triple cam operating whereby rotation of either handle in a downward direction causes the tongue of the primary lock to assume an unlatched position and upward rotation of either handle causes the triple cam to impart drive to the transmission means to cause the subsidiary locks to assume the locked position.

* * * * *